US008956797B2

(12) United States Patent
Nosella et al.

(10) Patent No.: US 8,956,797 B2
(45) Date of Patent: Feb. 17, 2015

(54) BATCH/CONTINUOUS PRODUCTION OF TONER

(71) Applicant: Xerox Corporation, Norwalk, CT (US)

(72) Inventors: Kimberly D Nosella, Mississauga (CA); Santiago Faucher, Oakville (CA)

(73) Assignee: Xerox Corporation, Norwalk, CT (US)

( * ) Notice: Subject to any disclaimer, the term of this patent is extended or adjusted under 35 U.S.C. 154(b) by 53 days.

(21) Appl. No.: 13/717,025

(22) Filed: Dec. 17, 2012

(65) Prior Publication Data

US 2014/0170558 A1 Jun. 19, 2014

(51) Int. Cl.
*G03G 9/08* (2006.01)

(52) U.S. Cl.
CPC ..... *G03G 9/0802* (2013.01)
USPC ..... 430/137.14

(58) Field of Classification Search
CPC ..... G03G 9/0804; G03G 9/08755; G03G 9/0806; G03G 9/0875
USPC ..... 430/137.14
See application file for complete search history.

(56) References Cited

U.S. PATENT DOCUMENTS

| | | | | |
|---|---|---|---|---|
| 7,452,654 | B2 * | 11/2008 | Hirose et al. | 430/137.14 |
| 2006/0286478 | A1 * | 12/2006 | Chung et al. | 430/109.1 |
| 2007/0082287 | A1 * | 4/2007 | Wolfe et al. | 430/137.14 |
| 2011/0217648 | A1 * | 9/2011 | Zhou et al. | 430/110.4 |

* cited by examiner

*Primary Examiner* — Hoa V Le
(74) *Attorney, Agent, or Firm* — MDIP LLC

(57) ABSTRACT

A process for forming toner using an emulsion/aggregation scheme wherein particle aggregation occurs in a batch reactor and coalescence occurs in a continuous reactor. In embodiments, a continuous reactor comprises four sections joined in series.

14 Claims, No Drawings

BATCH/CONTINUOUS PRODUCTION OF TONER

FIELD

The disclosure relates to a semi-continuous reaction scheme and device for producing an emulsion/aggregation toner, where coalescence occurs in a continuous reactor.

BACKGROUND

Industrial production of toner generally occurs through batch reactions. For example, is an emulsion/aggregation (EA) scheme, two reactors can be used, one batch reactor to accommodate particle formation and aggregation and then the slurry is transferred to a second batch reactor to finish the product by coalescence. The residence time of the reaction mixture in either tank can be about the same, and may range up through 8 hours or more.

A continuous process, if possible, can provide advantages over more conventional batch reactions by providing one or more of faster, efficient mixing, selectivity enhanced side products, reduced secondary reactions and side products, higher yield, fewer impurities, extreme reaction conditions, time and cost savings, and increased surface area to volume ratio that results in good mass and heat transfer.

Continuous processes however, do have some shortcomings, for example, because of the need for reactant and product communication devices, there is a risk of blocking such conduits with reactants and/or products. Hence, reactions that produce a solid product or side product, such as, solid halide salts, such as, sodium bromide, produced in a Buchwald reaction, toner particles and so on may not be amenable to a continuous process. Also, a continuous process may not yield a product suitable for comparable commercial use because of, for example, altered reaction kinetics.

SUMMARY

The disclosure provides a process and a device for combining batch and continuous reaction schemes for producing emulsion/aggregation toner. Aggregated particles from a batch reaction are coursed through and incubated or treated in a continuous reaction mechanism to finish toner production, such as, coalescence, with optional washing and other finishing processes, in a low volume continuous reaction device. The hybrid device that enables a semi-continuous process for making toner can increase the production capacity of current batch production plants by, for example, reducing the ramping and coalescence time, for example, to about 5 minutes or less.

Aggregated particles and reactants, often in a slurry, from the batch reactor are fed therefrom continuously, discontinuously or metered at controllable rates and in controllable amounts by communicating devices, such as, lines, conduits, tubing and so on, composed of suitable materials, to and for incubation in the continuous reactor. The communicating devices can comprise and the continuous reactor comprises one or more devices for controlling temperature of the contents therein, such as, a heating or cooling element. The heating and cooling elements can be positioned along the communication devices and along the flow path of the continuous reactor to provide a controlled or particular temperature profile for the communicated reactants within the communication device and the reactor or reactor unit and the aggregated particle slurry in the continuous reactor. A pump or urging device causes movement the slurry from the batch reactor to the continuous reactor. The continuous reactor can comprise other urging devices to maintain a desired flow rate therethrough. In embodiments, slurry movement thought a reactor or reactor unit occurs solely under or by gravity.

The continuous reactor comprises a series of tubes, channels, voids, tubular voids, voids within partially flattened or ovoid tubes and the like, any suitable flow path, wherein plural such continuous reactors can be connected in parallel, for example via a manifold, to provide in series a continuous directed flow path through a plurality of devices that comprise the reactor. The continuous reactor can comprise one or more temperature regulating devices, such as, a heating or cooling element, which can comprise a liquid, such as, an oil, that bathes the directed parallel flow path to provide the appropriate temperature or temperature profile along the flow path under which the reaction occurs. The flow path can be connected to an egress device by a communication device, such as, a line, conduit, tubing and the like to course the reacted mixture to a product receiving vessel. The reaction apparatus can be operated under pressure to reduce reagent and fluid boiling points and to ensure unimpeded or continuous movement and uniform flow of the reaction mixture through the reactor.

In embodiments, a continuous reactor of interest comprises a plurality of units comprising, for example, about four regions, flow paths, fluid flow paths, zones, subparts, sections and the like, where each region, zone and the like provides a different environment or different conditions for the slurry contained therein, such as, one region comprises conditions that move the slurry to a state that is conducive for particle aggregation and another region comprises conditions that move the slurry to a state that is conducive to halting an ongoing aggregation process. Another zone can provide a ramping of conditions for coalescence and another subsequent zone can be one where coalescence of particles occurs. In embodiments, the reactor comprises multiple units, parts, components and the like that are operably connected to provide a continuous flow path, where each unit provides a different environment for the contained slurry, and which is where a separate process of toner development occurs.

DETAILED DESCRIPTION

In the specification and the claims that follow, singular forms such as "a," "an," and, "the," include plural forms unless the content clearly dictates otherwise.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating" and "matching," or grammatic variations thereof, which generally have acceptable definitions, or at the least, are understood to have the same meaning as, "about."

"Connection," or, "communication," or grammatic forms thereof are used herein to encompass means or devices for communicating, transporting, connecting and so on two or more devices, such as, vessels or reactors, which can be, for example, a pipe, a tube, a tubing, a hose, a conduit, a straw and so on, any device that enables the movement of a fluid therein from one device to another, such as, from one reactor to another. Thus, an example of a connecting device is a tubing, which can be made of a plastic, a metal and so on.

The term, "flow path," can have multiple uses and meanings herein. A flow path generally defines the course followed by a toner particle slurry contained within a reactor of interest. A flow path also can be used to particularly define or describe the particular course of fluid flow through the reactor. A flow path also can generally include all of the physical boundaries that define the flow path or void within through which the fluid passes, such as, a tube wall, the tube and so on, as well as the entry point or site or ingress for fluid introduction into the reactor or that unit or component, and exit point or site or egress for fluid departure or removal from the reactor or from a component thereof Hence, a flow path also can be used to define the physical structure that creates the channel within to transport fluid and directs movement of the fluid therein. Generally, the fluid movement is unidirectional or linear from ingress to egress. The dimensions of the flow path generally are greater in the direction of the flow as compared to the diameter, cross-section or other metric that is generally perpendicular to the direction of flow. Thus, a flow path can be a tube, hose, pipe, plate and so on as a design choice.

The terms, "standard temperature," and, "standard pressure," refer, for example, to the standard conditions used as a basis where properties vary with temperature and/or pressure. Standard temperature is 0° C.; standard pressure is 101,325 Pa or 760.0 mmHg The term, "room temperature," refers, for example, to temperatures in the range of from about 20° C. to about 25° C.

The terms, "one or more," and, "at least one," herein mean that the description includes instances in which one of the subsequently described circumstances occurs, and that the description includes instances in which more than one of the subsequently described circumstances occurs.

Toner particles of interest can be of any composition so long as amenable to the continuous portion of the hybrid device and process of interest. Hence, the toner can be a polyester, a polystyrene and so on as known in the art. The following discussion is directed to polyester EA toner, but it is understood that the method and device can be used with essentially any toner chemistry.

In embodiments, suitable resins for forming a toner include polyester resins. Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as, 1,2-ethanediol, 1,3-propanediol, 1,4-butanediol, 1,5-pentanediol, 1,6-hexanediol, 1,7-heptanediol and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, mixtures thereof, and the like, and so on. The aliphatic diol may be, for example, selected in an amount of from about 40 to about 60 mole % (although amounts outside of those ranges may be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, and so on, and a diester or anhydride thereof The organic diacid may be selected in an amount of, for example, in embodiments from about 40 to about 60 mole %, although amounts outside of that range can be used.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate) and so on. Examples of polyamides include poly(ethylene-adipamide), poly(propylene-adipamide), poly(butylenes-adipamide), poly(pentylene-adipamide), poly(hexylene-adipamide) and so on. Examples of polyimides include poly(ethylene-adipimide), poly(propylene-adipimide), poly(butylene-adipimide), poly (pentylene-adipimide), poly(hexylene-adipimide) and so on.

Suitable crystalline resins include those disclosed in U.S. Publ. No. 2006/0222991, the disclosure of which is hereby incorporated by reference in entirety. In embodiments, a suitable crystalline resin may be composed of ethylene glycol and a mixture of dodecanedioic acid and fumaric acid comonomers.

The crystalline resin may be present, for example, in an amount of from about 5 to about 50% by weight of the toner components, but amounts outside of that range can be used. The crystalline resin may possess various melting points of, for example, from about 30° C. to about 120° C. The crystalline resin may have a number average molecular weight ($M_n$) as measured by gel permeation chromatography (GPC) of, for example, from about 1,000 to about 50,000 and a weight average molecular weight ($M_w$) of, for example, from about 2,000 to about 100,000, as determined by GPC. The molecular weight distribution ($M_w/M_n$) of the crystalline resin may be, for example, from about 2 to about 6. The crystalline polyester resins may have an acid value of less than about 1 meq KOH/g, from about 0.5 to about 0.65 meq KOH/g.

Polycondensation catalysts may be utilized in forming either the crystalline or amorphous polyesters and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof Such catalysts may be utilized in amounts of, for example, from about 0.01 mole % to about 5 mole %, based on the starting diacid or diester used to generate the polyester resin.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, and mixtures thereof The organic diacid or diester can be selected, for example, from about 45 to about 52 mole % of the resin, although amounts outside of that range can be used.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, and mixtures thereof The amount of organic diol selected may vary, and more specifically, is, for example, from about 45 to about 52 mole % of the resin, although amounts outside of that range can be used.

Suitable amorphous polyester resins include, but are not limited to, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate) and combinations thereof.

In embodiments, a suitable amorphous polyester resin may be a poly(propoxylated bisphenol A co-fumarate) resin. Examples of such resins and processes for their production include those disclosed in U.S. Pat. No. 6,063,827, the disclosure of which is hereby incorporated by reference in entirety.

In embodiments, a suitable amorphous resin utilized in a toner of the present disclosure may be a low molecular weight amorphous resin, sometimes referred to, in embodiments, as an oligomer, having an $M_w$ of from about 500 daltons to about 10,000 daltons. The amorphous resin may possess a $T_g$ of from about 55° C. to about 70° C. The low molecular weight amorphous resin may possess a softening point of from about 105° C. to about 120° C. The amorphous polyester resins may have an acid value of from about 8 to about 20 meq KOH/g.

In other embodiments, an amorphous resin utilized in forming a toner of the present disclosure may be a high molecular weight amorphous resin. The high molecular weight amorphous polyester resin may have, for example, an $M_n$, for example, from about 1,000 to about 10,000. The $M_w$ of the resin can be greater than 45,000. The polydispersity index (PD or PDI), equivalent to the molecular weight distribution, is above about 4. The high molecular weight amorphous polyester resins, which are available from a number of sources, may possess various melting points of, for example, from about 30° C. to about 140° C. High molecular weight amorphous resins may possess a $T_g$ of from about 50° C. to about 60° C.

One, two or more resins may be used. In embodiments, the resin may be an amorphous resin or a mixture of amorphous resins and the temperature may be above the $T_g$ of the mixture. In embodiments, where two or more resins are used, the resins may be in any suitable ratio (e.g., weight ratio) such as, for instance, of from about 1% (first resin)/99% (second resin) to about 99% (first resin)/1% (second resin), in embodiments, from about 4% (first resin)/96% (second resin) to about 96% (first resin)/4% (second resin).

Branching agents for use in forming branched polyesters include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, acid anhydrides thereof, and lower alkyl esters thereof, 1 to about 6 carbon atoms; a multivalent polyol, such as, sorbitol, 1,2,3,6-hexanetetrol, 1,4-sorbitane, pentaerythritol, dipentaerythritol, tripentaerythritol, sucrose, 1,2,4-butanetriol, mixtures thereof, and the like. The branching agent amount selected is, for example, from about 0.1 to about 5 mole % of the resin. The amorphous polyester resin may be a branched resin. As used herein, the terms, "branched," or, "branching," include branched resins and/or cross-linked resins.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), mixtures thereof and the like. The resins may also be functionalized, such as, carboxylated, sulfonated or the like, such as, sodio sulfonated.

In embodiments, colorants may be added to the resin mixture to adjust or to change the color of the resulting toner. In embodiments, colorants utilized to form toner compositions may be in dispersions. As the colorant to be added, various known suitable colorants, such as, dyes, pigments, mixtures of dyes, mixtures of pigments, mixtures of dyes and pigments, and the like, may be included in the toner. The colorant may be added in amounts from about 0.1 to about 35 wt %, or more, of the toner.

As examples of suitable colorants, mention may be made of $TiO_2$; carbon black like REGAL 330® and NIPEX® 35; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there may be selected cyan, magenta, yellow, orange, red, green, brown, blue or mixtures thereof. The pigment or pigments are generally used as water-based pigment dispersions.

Solvents may be added in the formation of the latexes to permit reorientation of chain ends to stabilize and to form particles which lead to the formation of stable latexes without surfactant. In embodiments, solvents sometimes referred to, as phase inversion agents, may be used to form the latex. The solvents may include, for example, acetone, toluene, tetrahydrofuran, methyl ethyl ketone, dichloromethane, combinations thereof and the like.

In embodiments, a solvent may be utilized in an amount of, for example, from about 1 wt % to about 25 wt % of the resin. In embodiments, an emulsion formed in accordance with the present disclosure may also include water, in embodiments, de-ionized water (DIW), in amounts from about 30% to about 95%, at temperatures that melt or soften the resin, from about 20° C. to about 120° C.

The particle size of the emulsion may be from about 50 nm to about 300 nm.

In embodiments, a surfactant may be added to the resin, and to an optional colorant to form emulsions. One, two or more surfactants can be used. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration from about 5% to about 100% (pure surfactant) by weight. In embodiments, the surfactant may be utilized so that it is present in an amount from about 0.01 wt % to about 20 wt % of the resin. Combinations of the surfactants may be utilized in embodiments.

Optionally, a wax may be combined with the resin in forming toner particles. The wax may be provided in a wax dispersion, which may include a single type of wax or a mixture of two or more different waxes. Wax may be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes may be added to provide multiple properties to the toner composition. When included, the wax may be present in an amount of, for example, from about 1 wt % to about 25 wt % of the toner particles.

Optionally, a coagulant may also be combined with the resin, optional colorant and a wax in forming toner particles. Such coagulants may be incorporated into the toner particles during particle aggregation. The coagulant may be present in the toner particles, exclusive of external additives and on a dry weight basis, in an amount of, for example, from about 0.01 wt % to about 5 wt % of the toner particles.

Coagulants that may be used include, for example, an ionic coagulant, such as a cationic coagulant. Inorganic cationic coagulants include metal salts, for example, aluminum sulfate, magnesium sulfate, zinc sulfate and the like. Examples of organic cationic coagulants may include, for example, dialkyl benzenealkyl ammonium chloride, lauryl trimethyl ammonium chloride, combinations thereof and the like. Other suitable coagulants may include, a monovalent metal coagulant, a divalent metal coagulant, a polyion coagulant, or the like. As used herein, "polyion coagulant," refers to a coagulant that is a salt or oxide, such as a metal salt or metal oxide, formed from a metal species having a valence of at least 3. Suitable coagulants thus may include, for example, coagulants based on aluminum salts, such as aluminum sulfate and aluminum chlorides, polyaluminum halides such as polyaluminum fluoride and polyaluminum chloride (PAC), polyaluminum silicates such as polyaluminum sulfosilicate (PASS), polyaluminum hydroxide, polyaluminum phosphate, combinations thereof and the like. Other suitable coagulants may also include, but are not limited to, tetraalkyl titinates, dialkyltin oxide, tetraalkyltin oxide hydroxide, dialkyltin oxide hydroxide, aluminum alkoxides, combinations thereof, and the like. Where the coagulant is a polyion coagulant, the coagulants may have any desired number of polyion atoms present. For example, in embodiments, suitable polyaluminum compounds may have from about 2 to about 13 aluminum ions present in the compound.

The aggregating agent or coagulant may be added to the mixture utilized to form a toner in an amount of, for example, from about 0.1 to about 10 wt % of the resin in the mixture.

Thus, in embodiments, a process of the present disclosure includes combining or contacting at least one resin, for example, with a surfactant to form a resin mixture, contacting the resin mixture with a solution of an optional pigment, optional surfactant and water to form a phase inversed latex emulsion, distilling the latex to remove a water/solvent mixture in the distillate and producing a high quality latex in a batch reaction. In the phase inversion process, the resins may be dissolved in a solvent noted above, at a concentration from about 1 wt % to about 85 wt % resin in solvent.

In embodiments, a pigment, optionally in a dispersion, may be mixed together with a neutralizing agent or base solution (such as sodium bicarbonate) and optional surfactant in DIW to form a phase inversion solution. The resin mixture may then be combined or contacted with the phase inversion solution to form a neutralized solution. The phase inversion solution may be combined or contacted with the resin mixture to neutralize acid end groups on the resin and to form a uniform dispersion of resin particles through phase inversion. The solvents remain in both the resin particles and water phase at that stage. Through vacuum distillation, for example, the solvents can be removed.

In embodiments, the neutralizing agent or base solution which may be utilized in the process of the present disclosure includes the agents mentioned hereinabove. In embodiments, the optional surfactant utilized may be any of the surfactants mentioned hereinabove to ensure that proper resin neutralization occurs and leads to a high quality latex with low coarse content.

DIW may be added to form a latex emulsion with a solids content of from about 5% to about 50%. While higher water temperatures may accelerate the dissolution process, latexes may be formed at temperatures as low as room temperature (RT). In embodiments, water temperatures may be from about 40° C. to about 110° C.

Stirring, although not necessary, may be utilized to enhance formation of the latex. Any suitable stirring device may be utilized. In embodiments, the stirring may be at a speed from about 10 revolutions per minute (rpm) to about 5,000 rpm. The stirring need not be at a constant speed, but may be varied. For example, as the heating of the mixture becomes more uniform, the stirring rate may be increased. In embodiments, a homogenizer (that is, a high shear device), may be utilized to form the phase inversed emulsion, but in other embodiments, the process of the present disclosure may take place without the use of a homogenizer. Where utilized, a homogenizer may operate at a rate from about 3,000 rpm to about 10,000 rpm.

The coarse content of the latex of the present disclosure may be from about 0.01 wt % to about 5 wt %. By coarse content is meant larger particles that are more than 20% larger than the mean particle size of the desired population of particles. The solids content of the latex of the present disclosure may be from about 5 wt % to about 50 wt %. In embodiments, the molecular weight of the resin emulsion particles of the present disclosure may be from about 18,000 grams/mole to about 26,000 grams/mole.

The pH of the mixtures may be adjusted by an acid such as, for example, acetic acid, sulfuric acid, hydrochloric acid, citric acid, trifluro acetic acid, succinic acid, salicylic acid, nitric acid or the like. In embodiments, the pH of the mixture may be adjusted to from about 2 to about 5. In embodiments, the pH is adjusted utilizing an acid in a diluted form of from about 0.5 to about 10 wt % by weight of water, in embodiments.

Examples of bases used to increase the pH and ionize the aggregated particles, thereby providing stability and preventing the aggregates from growing in size, may include sodium hydroxide, potassium hydroxide, ammonium hydroxide, cesium hydroxide and the like, among others.

Essentially any batch reaction process for producing toner particles to be committed to aggregation and coalescence or similar finishing treatment, such as exposure to changing temperature and/or pH regimens, to obtain a toner particle, can be used in the practice of the method of interest, using a reactor of interest.

The particles may be permitted to aggregate in a batch reactor until a predetermined desired particle size is obtained. A predetermined desired size refers to the particle size to be obtained as determined prior to formation, with the particle size monitored during the growth process until such particle size is attained. Samples may be taken during the growth process and analyzed, for example, with a COULTER COUNTER, for average particle size. The aggregation thus may proceed by maintaining the elevated temperature, or slowly raising the temperature to, for example, from about 40° C. to about 55° C., and holding the mixture at that temperature, while maintaining stirring, to provide the aggregated particles. Once the predetermined desired particle size is reached, then the growth process is halted.

Once the desired final size of the toner particles is achieved, the particles or the slurry comprising the particles can be transferred, transported, coursed, urged, directed and so on to a continuous reactor. The movement from the batch reactor to the continuous reactor can be continuous or discontinuous, assisted or under gravity, as a design choice. The pH of the mixture may be adjusted with a base to a value from about 4 to about 10. The adjustment of the pH may be utilized to freeze, that is, to stop, toner growth. The base utilized to stop toner growth may include any suitable base, such as, for example, alkali metal hydroxides such as, for example, sodium hydroxide, potassium hydroxide, ammonium hydroxide, combinations thereof, and the like. In embodiments, ethylene diamine tetraacetic acid (EDTA) or other chelator may be added as an ion sequestering agent that can also help adjust the pH to the desired values noted above.

In embodiments, during aggregation, but prior to coalescence, a shell may be applied to the aggregated particles. Any resin described above as suitable for forming the core resin may be utilized as the shell. In embodiments, an amorphous polyester resin as described above may be included in the shell. Multiple resins may be utilized in any suitable amounts. In embodiments, a first amorphous resin may be present in an amount of from about 20% by weight to about 100% by weight of the total shell resin. The shell resin can comprise a colorant.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles.

The aggregated particles in the batch reactor are then directed to the continuous flow reactor of interest to begin the coalescence of the particles. No particular design of the continuous flow minireactor or microreactor is intended so long as the slurry or batch reactor liquid contents incubate or are treated in the continuous reactor as needed or as desired, for example, for coalescence processes to occur on a continuous basis in low volume.

Coalescence to the desired final shape can be achieved by, for example, heating the mixture to a temperature from about 45° C. to about 100° C., which may be at or above the $T_g$ of the resins utilized to form the toner particles. The fused particles may be measured for shape factor or circularity, such as with a Sysmex FPIA 2100 analyzer, until the desired shape is achieved. Coalescence may be accomplished over a period of minutes, such as, from about 1 min to about 30 min, although times outside of that range can be used as a particle of a desired property is the defining endpoint. Mixture flow through the continuous reactor can be set at a level that ensures mixing of any additives and movement of the particles within the fluid medium to enable coalescence.

Over the course of movement of a slurry through the continuous reactor, the temperature of a slurry at the egress from the reactor, that is, following coalescence, can be higher that the temperature of the slurry entering the continuous reactor, that is, at aggregation. That overall increase in temperature need not be continuous and temperature may oscillate over the length of the continuous reactor between ingress and egress of the slurry in the continuous reactor.

Circularity of the particles can be at least about 0.950, at least about 0.960, at least about 0.970, or greater.

After coalescence, the mixture may be cooled to room temperature, such as from about 20° C. to about 25° C. The cooling may be rapid or slow, as desired. A suitable cooling method may include introducing cold water to a jacket around the reactor, or the use of a heat exchanger. In embodiments, the continuous reactor outflow can be directed or dispensed into a water bath, which may be cooled or at room temperature, for example. After cooling, the toner particles optionally may be washed with water, and then dried. Drying may be accomplished by any suitable method for drying including, for example, freeze drying.

As known in the art, toner particles may also contain other optional additives, as desired or required. For example, the toner may include positive or negative charge control agents, for example in an amount from about 0.1 to about 10 wt % of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in entirety; organic sulfate and sulfonate compositions, including those disclosed in U.S. Pat. No. 4,338,390, the disclosure of which is hereby incorporated by reference in entirety; combinations thereof and the like. Such charge control agents may be applied simultaneously with the shell resin described above or after application of the shell resin.

There may also be blended with the toner particles external additive particles after formation including flow aid additives, which additives may be present on the surface of the toner particles. Examples of the additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof External additives may be present in an amount from about 0.1 wt % to about 5 wt % of the toner. In embodiments, the toners may include, for example, from about 0.1 wt % to about 5 wt % titania, from about 0.1wt % to about 8 wt % silica, from about 0.1 wt % to about 4 wt % zinc stearate.

Suitable additives include those disclosed in U.S. Pat. Nos. 3,590,000 and 6,214,507, the disclosure of each of which hereby is incorporated by reference in entirety. Again, the additives may be applied simultaneously with the shell resin described above or after application of the shell resin.

The assembly or apparatus that can be used generally comprises parts, units and components known in the art, and reference can be made to the teachings of U.S. Pat. Nos. 7,563,318, 7,563,932 and 7,767,856, herein incorporated by reference in entirety. However, any design of the continuous reactor can be practiced.

Tubing, lines, conduits and other connections, transporting devices or communication devices are used to operably interconnect and to transport materials from the batch reactor or reservoirs to the continuous reactor apparatus between or among components of a continuous reactor of interest. The bore, width, inside dimension, cross-sectional area of the void of the flow path within the continuous reactor can be greater than that of the connections to and from the reactor. Such connections can be of any material suitable to withstand the temperatures and pressures used, as well as the reagents. Thus, for example, a connection or connecting device can comprise a metal, such as, stainless steel, a plastic and so on. The size of the connections and of the reactor is a design choice, and relates in part, for example, to the projected amount of product desired, the desired flow rate, the desired yield and the desired temperature control, for example. The material comprising the connections and/or the continuous reactor is one which is conducive to temperature change to permit rapid transfer of heat into and out of the connection, conduit or reactor to enable temperature control of the fluid contents within.

In embodiments, reactor volume can be less than about 10 ml, less than about 30 ml, less than about 50 ml or larger. In embodiments, the continuous reactor volume is measured in ounces, milliliters, cubic centimeters, gallons, liters or larger, such as, at least about 20 gal, at least about 30 gal, at least about 40 gal or larger. The volume need not be large or excessive, to minimize material for constructing the reactor and the space to house the reactor, as yield can be sufficient in a smaller volume by controlling flow rate, inner cross-sectional area of a flow path, residence time and so on.

Flow path length is one of feature that can be varied as a design choice to obtain a desired endpoint. Flow path length can be varied in combination with conduit and reactor cross-sectional area, and hence, volume, and flow speed. As provided herein, the flow path may be direct between two points, that is, a straight path, such as, a straight tube, or may follow an indirect path, for example, to increase flow path length in a given space, such as, a coil. Hence, the flow path can be, for example, measured in inches, centimeters, feet, yards, meters and so on, such as, at least about 1 ft, at least about 2 ft, at least about 3 ft or longer for production scale reactors, or scaled in inches for bench top reactors. Lengths outside of those ranges can be used.

The flow path may comprise a void or that void may comprise structures therein to encourage or to produce stirring of the slurry within. Hence, a flow path may comprise vanes, wings, screws, baffles, fins and other structures that impede direct flow of the slurry through the flow path, and are constructed and placed within the void to result in slurry agitation. A flow path also can comprise a mixing device, such as, an impeller or other motorized stirring device for an active mixing of the slurry within a flow path.

A continuous reactor comprises plural parts (components, flow paths, units, modules and the like, each of which is a synonym of another such term), where each unit is employed to exercise a different function or role in providing an environment for a step in toner particle development. Thus, for example, the modules can each be a straight tube connected with a suitable connector, such as, a U joint, a hose, a valve and so on. In embodiments, a reactor can comprise four such parts operably connected in series to form a continuous flow path, where each tube or multiple tubes are dedicated to a particular step in toner development, and thus, adjacent or successive reactors differ in the environment contained therein and the condition monitoring devices and reagent addition devices for each reactor can vary. Hence, in an example, the first reactor which accepts the toner particles from the batch reactor provides the reaction conditions for enabling particle aggregation, the second reactor is one which enables aggregation to cease, the third reactor provides a transitional environment from aggregation freezing to that found during coalescence, and the fourth reactor provide conditions that enable particle coalescence.

Residence times in such a plural component or compartment reactor can vary or can be controlled in each compartment (which is synonymous with component, portion, module, device and the like to indicate one segment of the device for producing toner once aggregated particles are introduced thereto) or across all reactors so that a slurry or liquid contents within the reactor can incubate suitably for desired processes to occur. For example, flow rate can be controlled in an upstream first portion by limiting the egress of slurry from that first portion at the juncture of that first portion with a downstream second portion. Hence, sites or devices joining plural components, for example, may comprise a restricted flow path or a fluid urging device, as a design choice, can be used to control residence time, for example, by the fluid flow rate, in any one component or across the complete continuous reactor.

Hence, residence time or how long a slurry incubates in a reactor or module, or across all reactor components can be about 10 min or less, about 5 min or less, about 2 5 min or less, about 1 min or less, although times outside of those ranges can be practiced. In embodiments, a continuous reactor can comprise one module, two modules, three modules, four modules, five modules or more, as a design choice.

In embodiments where aggregation may occur in a first module, the temperature of the fluid or slurry within can be controlled to be from about 40° C. to about 50° C., from about 42° C. to about 48° C., from about 44° C. to about 46° C.

In embodiments where a second module may house where aggregation ceases or is frozen, the fluid or slurry within can be controlled to have a temperature from about 58° C. to about 70° C., from about 60° C. to about 68° C., from about 62° C. to about 66° C.

In embodiments, a third module may be where temperature is ramped for particle coalescence, the fluid or slurry within can be controlled to have a temperature from about 74° C. to about 85° C., from about 76° C. to about 83° C., from about 78° C. to about 81° C.

In embodiments wherein a fourth module is present and comprises where coalescence occurs, the fluid or slurry within can be controlled to have a temperature from about 80° C. to about 90° C., from about 82° C. to about 88° C., from about 84° C. to about 86° C.

pH in a component also can be controlled by monitoring using known devices and introducing a suitable acid, base or buffer to obtain the desired pH. Hence, in embodiments where a first module as above is where aggregation occurs, a suitable pH may be from about 2 to about 5, from about 2.4 to about 4.6, from about 2.8 to about 4.4.

In embodiments wherein a second module is where aggregation ceases, a suitable pH is about from about 7 to about 8.2, from about 7.2 to about 8, from about 7.4 to about 7.8.

In embodiments wherein a third module may be used for ramping for coalescence, a suitable pH is about from about 5.6 to about 6.5, from about 5.8 to about 6.7, from about 6 to about 6.5.

In embodiments where a fourth module is present and is where coalescence occurs, a suitable pH can be about from about 5.6 to about 7.2, from about 5.8 to about 7, about 6 to about 6.8. With shorter residence times, more concentrated or greater amounts of acid, base or buffer can be introduced into the reactor.

The reactor can be designed in a modular form to enable changes to reactor size and volume as a design choice. Thus, a reactor can comprise plural conduits to increase unit volume treated per unit time, which can be connected in parallel to the batch reactor by, for example, a manifold or other device to distribute the feed slurry of aggregated particles from the batch reactor substantially equally to each of the plural continuous reactors.

The reaction can be carried out at pressures higher than atmospheric pressure, dictated, for example, by solvent(s) used and the operating temperature, or to ensure a steady and regular flow of fluid therethrough. For example, the operating pressure can be more than about 125 psi, more than about 150 psi, more than about 175 psi. Not wanting to be bound by theory, it is believed the controlled pressure ensures continual movement of fluids and suspensions through the reactor, and provides the observed enhanced reaction efficacy and enhanced product yield.

The configuration and make-up of the continuous reactor is not limited and generally can be presented, for example, in the form of parallel tubes, stacked plates, coiled tubes and so on to provide the requisite volume and continuously ce area exposure to an inner surface of the flow path material and other features that typify microreactors, minireactors and continuous flow reactors. As coalescence is dependent on temperature, the reactor is constructed of materials that readily conduct heat and can be enclosed, contained or by other configuration contacted with a device that contributes or removes heat so that the temperature of the fluid contents within the reactor is controlled as readily as possible. Thus, portions of the flow path can be contained within a jacket that enables, for example, a heating or cooling liquid to flow in the void between the jacket and the outer surface of the reactor.

The voids within the communication devices and the continuous reactor can comprise structures therewithin for facilitating, enhancing or assuring mixture of the solution therein. Hence, the void can comprise baffles, channels, ridges, obstructions or other structures that do not substantially impede the overall flow of fluid through the communication device or the reactor but which cause or urge a mixing or fluid movement tangential or perpendicular to the flow path. The structures can be present at particular sites, for example downstream from a site where a reagent is added to the reaction mixture up through throughout the length of the continuous reactor.

The continuous reaction can be conducted under an atmosphere of inert gas (such as nitrogen or argon) so as to minimize or to preclude reactant degradation, maintain toner particle integrity or to control reaction conditions.

Reagents can be introduced into the continuous reactor using, for example, pumps, valves, ports and the like suitably located along the flow path which enable graded or metered introduction of reactants and which maintain the reaction environment, such as, suitable or desired fluid flow, suitable pH and suitable temperature, for example, through length of the continuous reactor.

The residence time necessary in the method according to the invention depends on various parameters, such as, for example, the temperature, flow rate and so on. The term, "residence time," refers to the internal volume of the reaction zone within the apparatus occupied by the reactant fluid flowing through the space divided by the average volumetric flow rate for the fluid flowing through the space, at the temperature and pressure being used. The residence time for each reactor or across all modules may be, for example, from about 0.5 min to about 20 min, from about 1 min to about 15 min, from about 2 min and 10 min, although residence times outside of those ranges can be practiced as a design choice. In embodiments, the residence time can be less than about 1 min, less than about 2 min, less than about 5 min, less than about 10 min and so on, although residence times outside of those limits can be used.

As taught herein, a factor that contributes to residence time is the fluid flow speed through the reactor, which can be varied, for example, by gravity, internal structures as taught hereinabove, pumps and so on. Hence, the flow speed is controllable and can be at about 10 ml/min up through 200 ml/min or more, although flow speeds outside of that range can be used.

As taught herein, the temperature of the liquid in the flow path is controlled by various temperature control devices, such as, a heating coil, a jacket and so on to produce a controlled temperature regimen along the length of the flow path. Multiple temperature control devices can be placed along the flow path length so that defined temperature profiles are obtained along the length of the flow path. Thus, temperature can remain constant throughout the flow path; continuously increase along the length of the flow path; increase at the input to the reactor from the batch reactor but only for that portion of the reactor, which may comprise one half of the flow path, one third of the flow path and so on as a design choice, with no further heating to enable the fluid contents to cool at a defined temperature erosion rate through the remainder of the flow path; may be designed to increase to a defined temperature, remain at that temperature for a defined length of flow path, and then ramped, that is, heated further or cooled to a defined lower temperature, to provide a particularly designed temperature profile along the length of the flow path and so on.

A measure of reaction efficiency is the metric, space-time yield (STY) expressed in grams/liter/hour. The greater the value, the more efficient and more productive the method as greater amounts of product are obtained per unit volume of reaction mixture per unit time. The hybrid process of interest can produce an STY of at least about 1000 g/l/hr, at least about 1500 g/l/hr, at least about 2000 g/l/hr, at least about 2500 g/l/hr or more. As compared to a complete batch process, a hybrid continuous process of interest can produce an STY at least about 50 times as great, at least about 100 times as great, at least about 200 times as great or more than what is observed for a batch process.

Another metric of reaction efficiency is rate product, expressed as weight of slurry product per unit time. The reaction of interest has a slurry product rate of at least about 10 g/min, at least about 50 g/min, at least about 100 g/min, at least about 200 g/min, at least about 250 g/min, at least about 300 g/min, or more.

After coalescence is completed, the desired particles are removed from the continuous reactor and treated as known in the art, such as, washed and dried practicing methods known in the art. The particles can be mixed with various surface additives and the like, mixed with a carrier and so on to produce developer, as known in the art.

Specific examples are described in detail below. The examples are intended to be illustrative, and the materials, conditions and process parameters set forth in the exemplary embodiments are not limiting. All parts and percentages are by weight relative to the toner unless otherwise indicated.

EXAMPLES

Example 1

A cyan feed polyester EA toner slurry was prepared in a 3 L glass kettle equipped with a large fan impeller (339.7 g dry theoretical toner). Two amorphous resin emulsions (247 g of Resin 1, $M_w$=86,000, $T_g$ onset=56° C.; and 259 g of Resin 2, $M_w$=19,400, $T_g$ onset=60° C.) containing 2% surfactant (Dowfax2A1), 66 g crystalline resin emulsion ($M_w$=23,300, $M_n$=10,500, $T_m$=71° C.) containing 2% surfactant (Dowfax2A1), 103 g wax (IGI, Toronto, Calif.), 1276 g of DIW and 120 g cyan pigment (PB 15:3 dispersion) are combined in the kettle, then pH adjusted to 4.2 using 0.3 M nitric acid. The slurry is then homogenized for 5 min at 3000-4000 rpm while adding coagulant consisting of 6.09 g aluminum sulphate mixed with 75 g DIW. The slurry is mixed at 315 rpm and heated to a batch temperature of 43° C. During aggregation, a shell resin mixture comprised of the same amorphous emulsions as in the core (137 g of Resin 1 and 137 g of Resin 2, both containing 2% DowFax2A1) is pH adjusted to 3.3 with nitric acid and was added to the batch. Then the batch mixing is increased to 370 rpm to achieve the targeted particle size. Once the target particle size is achieved, a pH adjustment is made to 7.8 using NaOH and EDTA to freeze the aggregation process.

Example 2

The feed slurry then was pumped into the microreactor continuously at 20 g/min or 40 g/min for a 10 min or 5 min incubation or residence time. The microreactor comprised four straight stainless steel tubes comprising plural valves for reagent introduction, plural devices for monitoring pH and temperature and plural devices for temperature control along the flow path, connected in series. Each of the four reactors was controlled to provide unique environments to enable aggregation, aggregation freezing, ramping and coalescence, respectively. The temperature of each section, identified as R1, R2, R3 and R4, is as follows:

TABLE 1

| Reactor temperatures | | | | |
|---|---|---|---|---|
| Residence Time | R1 | R2 | R3 | R4 |
| 10 min | 45° C. | 65° C. | 81° C. | 85° C. |
| 5 min | 45° C. | 63° C. | 78.5° C. | 84° C. |

TABLE 2

| Pump Rates of NaOH and pH 5.7 Buffer and Circularity | | | | | |
|---|---|---|---|---|---|
| Residence Time | R2 | 4% NaOH to R2 | R4 | pH 5.7 Buffer to R4 | Circularity |
| 10 min | | 0.3 g/min | pH 6.6-6.5 | 0.55 g/min | 0.955-0.965 |
| 5 min | pH 7.6-7.8 | 0.3 g/min | pH 6.4-6.5 | 1 g/min | 0.964-0.970 |

The particles obtained with a 10 min residence time had a circularity of 0.957. The particles with a 5 min residence time had a circularity of 0.966.

Example 3

The batch material was that of Example 1. The materials and methods of Example 2 were practiced except the flow rate was 40 g/min for a residence time of 5 min. The following conditions were used:

TABLE 3

| Pump rates of NaOH and pH 5.7 Buffer and Circularity | | | | | | | |
|---|---|---|---|---|---|---|---|
| Residence Time | R2 | 4% NaOH to R2 | R3 | pH 5.7 Buffer to R3 | R4 | pH 5.7 Buffer to R4 | Circularity |
| 5 min | 7.4-7.6 | 0.2 g/min | 6.2-6.3 | 1 g/min | 6.0-6.1 | 0.4 g/min | ≥0.970 |

TABLE 4

| Reactor Temperatures | | | | |
|---|---|---|---|---|
| Residence Time | R1 | R2 | R3 | R4 |
| 5 min | 46° C. | 65° C. | 81° C. | 85° C. |

About 130 g of toner were obtained over 26 min. The toner released from the reactor was quenched cooled in an ice bath. The circularity was 0.975. The toner was washed, dried and then frozen for subsequent characterization.

ICP mass spectrometry revealed presence and amount of the following ions:

| ICP | Al | Na | Sn | Fe | Cu | Ca |
|---|---|---|---|---|---|---|
| (ppm) | 60.03 | 546 | 427.2 | 8.53 | 6169 | 4.34 |

The toner particles are combined with a carrier and then were tested for charging and fusing, using a commercially available batch produced toner for comparison. A, B and C zone charging at 2, 10 and 60 min, charge maintenance for 1 and 7 days and blocking values at three temperatures were substantially the same between the control batch toner and the experimental hybrid batch/continuous toner of interest. Cold offset, gloss at MFT, peak gloss, mottle, hot offset and fusing latitude values for the control batch toner and the experimental hybrid batch/continuous toner were substantially the same.

Hence, the shorter aggregation, aggregation freezing and coalescence times practiced in using the continuous reactor did not negatively impact the resulting toner particles which presented with properties comparable to that of a commercial toner made by a batch process only.

All references cited herein are herein incorporated by reference in entirety.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

We claim:

1. A semi-continuous process for producing a toner particle of circularity at least about 0.950 comprising:

(a) combining a resin, an optional colorant, an optional wax and an optional surfactant to produce an aggregated particle in a slurry in a batch reactor; and then (b) treating said aggregated particle in said slurry to coalesce said aggregated particle to produce said toner particle in a continuous reactor, wherein said continuous reactor comprises in series:

(i) a first portion for facilitating introduction of the aggregated particle in said slurry into the continuous reactor, wherein temperature of the slurry in said first portion is from about 40° C. to about 50° C.;

(ii) a second portion for facilitating stopping aggregated particle growth, wherein temperature of the slurry in said second portion is from about 58° C. to about 70° C.;

(iii) optionally, a third portion for facilitating temperature increase of said slurry; and (iv) a fourth portion for facilitating particle coalescence, wherein a space time yield (STY) of the toner particles is at least about 1000 g particles/L/hr.

2. The semi-continuous process of claim 1, wherein the slurry is continuously pumped from the batch reactor to the continuous reactor.

3. The semi-continuous process of claim 1, wherein temperature of slurry exiting said continuous reactor is higher than temperature of slurry entering said continuous reactor.

4. The semi-continuous process of claim 1, wherein temperature of the slurry in said first portion is from about 44° C. to about 46° C.

5. The semi-continuous process of claim 1, wherein temperature of the slurry in said second portion is from about 62° C. to about 66° C.

6. The semi-continuous process of claim 1, wherein temperature of the slurry in said optional third portion is from about 74° C. to about 85° C.

7. The semi-continuous process of claim 1, wherein temperature of the slurry in said fourth portion is from about 80° C. to about 90° C.

8. The process of claim 1, wherein said toner particle comprises a circularity of at least about 0.960.

9. The process of claim 1, wherein said toner particle comprises a circularity of at least about 0.970.

10. The process of claim 1, wherein residence time of each portion is from about 0.5 min to about 20 min.

11. The process of claim 1, wherein a portion comprises an impeller.

12. The process of claim 1, comprising controlling slurry feed rate to each portion.

13. The process of claim 1, wherein said first, second, optional third and fourth portions comprise a unit.

14. The process of claim 1, wherein each of said first, second, optional third and fourth portions comprises a unit connected in series.

* * * * *